US006539858B2

(12) United States Patent
Aoyama et al.

(10) Patent No.: US 6,539,858 B2
(45) Date of Patent: Apr. 1, 2003

(54) DIGITAL PRINTING PRESS

(75) Inventors: Hideo Aoyama, Fuchu (JP); Liang Dong, Fuchu (JP)

(73) Assignee: Ryobi LTD, Hiroshima-ken (JP)

( * ) Notice: Subject to any disclaimer, the term of this patent is extended or adjusted under 35 U.S.C. 154(b) by 0 days.

(21) Appl. No.: 09/997,534

(22) Filed: Nov. 29, 2001

(65) Prior Publication Data

US 2002/0073857 A1 Jun. 20, 2002

(30) Foreign Application Priority Data

Dec. 18, 2000 (JP) ..... 2000-383768

(51) Int. Cl.[7] ..... B41F 16/00

(52) U.S. Cl. ..... 101/142; 101/183; 101/216; 101/247

(58) Field of Search ..... 101/216, 142, 101/247, 350.3, 352.06, 219, 484, 183

(56) References Cited

U.S. PATENT DOCUMENTS 6,302,018 B1 * 10/2001 Aoyama et al. ..... 101/142

* cited by examiner

*Primary Examiner*—Andrew H. Hirshfeld
*Assistant Examiner*—Kevin D. Williams
(74) *Attorney, Agent, or Firm*—Perkins Coie LLP

(57) ABSTRACT

A printing unit, a sheet-feeding unit, a sheet-discharging unit, an ink-feeding unit and a roller-oscillating unit of a digital printing press are adapted to receive the driving force from a common motor. An image-forming device fixedly mounted on the digital printing press is adapted to form images on printing plates mounted on the printing unit as the plate cylinder rotates upon receiving the driving force from the common motor. The transmission of the driving force to at least two of the sheet-feeding unit, the sheet-discharging unit, the ink-feeding unit and the roller-oscillating unit is shut off by means of a single clutch during the image-forming operation.

2 Claims, 5 Drawing Sheets

DIGITAL PRINTING PRESS

BACKGROUND OF THE INVENTION

1. Field of the Invention

The present invention relates to improvements in a digital printing press equipped with an image-forming device.

2. Discussion of the Background

A digital offset printing press of the above type is illustrated in FIG. 5. The printing press includes a printing unit for printing on sheets, a sheet-feeding unit for feeding sheets onto the printing unit, and a sheet-discharging unit for discharging sheets printed at the printing unit to the outside of the printing unit.

The printing unit in turn includes impression cylinder 3, and two plate cylinders 1 and two blanket cylinders 2 respectively disposed on the upstream and downstream sides of the impression cylinder 3. The plate cylinders 1 each are provided on its outer circumference with a printing plate or printing plates. The blanket cylinders 2 each transfer ink images from the plate cylinder 1 onto its outer circumference. The impression cylinder 3 transfers the ink images on the blanket cylinders 2 onto oncoming sheets held on its outer circumference. The printing press having this arrangement is designed for printing on each sheet in two color during every one rotation of the impression cylinder 3. To achieve this two-color printing, the two plate cylinders 1 and two blanket cylinders 2 are arranged with a predetermined spacing from each other along the circumferential surface of the impression cylinder 3.

According to the above arrangement, the printing press can print on each sheet held on the impression cylinder 3 in a total of four colors during every time the impression cylinder 3 rotates twice. To achieve this operation, the plate cylinders 1 and the blanket cylinders 2 each are designed as a so-called double-diameter cylinder. That is, the plate cylinder 1 and the blanket cylinder 2 on each side respectively provide outer circumferences each being equally divided into two segments, on which ink images in different colors are respectively formed. The plate cylinder 1 on each side is provided on each segment with a different printing plate. The impression cylinder 3 is designed as a so-called three-diameter cylinder that provides the outer circumference equally divided into three segments, each of which segment receives thereon one sheet.

The printing press also includes image-forming devices 4 disposed on the upstream and downstream sides that are fixed in position with a predetermined spacing from the outer circumferences of the respective plate cylinders 1 for forming images on the printing plates mounted on the plate cylinder 1 on each side. The printing press is provided with two sets of ink-feeding units 5, each set comprised of two ink-feeding units 5 and disposed around the plate cylinder 1 on each side. A total of four ink-feeding units 5 are thus arranged in the printing unit.

The ink-feeding units 5 represented by triangles in FIG. 5 each include a number of ink rollers that respectively have rotational axes extending parallel with the axis of a corresponding cylinder and feed inks onto the printing plates through the rotations thereof. One or more of these ink rollers are designed as laterally-oscillating rollers, which are also referred merely to oscillating rollers. The oscillating rollers are reciprocally moved in the lateral direction or along the cylinder axes to feed inks onto the printing plates as even-outing the ink distribution along the lateral or width direction of the printing press (i.e. the direction orthogonal to the sheet feeding path).

On the other hand, the sheet-feeding unit disposed on the upstream side of the impression cylinder 3 (i.e., right-hand side of the impression cylinder in FIG. 5) includes a sheet-feeding cylinder 6 disposed as facing the impression cylinder 3. The sheet-feeding cylinder 6 transfers each sheet to an oncoming one of grippers 7 of the impression cylinder 3 every time the impression cylinder 3 rotates twice. The sheet-feeding cylinder 6 is designed as a single-diameter cylinder that receives a single sheet on its outer circumference.

The sheet-discharging unit disposed on the downstream side of the impression cylinder 3 (i.e., left-hand side of the impression cylinder 3 in FIG. 5) includes a pair of sheet-discharging sprockets 8, an endlessly-formed transfer chain 9 adapted to be driven through the pair of sheet-discharging sprockets 8, and sheet-discharging grippers 10 fixed on the transfer chain 9 as aligned along the lengthwise direction of the transfer chain 9 with a predetermined spacing from each other. The sheet-discharging grippers 10 each receive a printed sheet from the impression cylinder 3 every time the impression cylinder 3 rotates twice.

The thus arranged printing press is actuated by means of a single driving source. Specifically, the printing unit, the sheet-feeding unit, the sheet-discharging unit and the ink-feeding units 5 are actuated in synchronization with each other upon receiving the driving force of a single motor 11 mounted on the printing press. The driving force of the motor 11 is also received by roller-oscillating units which in turn convert rotary motion into linear motion via motion converting means to reciprocally move the oscillating rollers.

The driving-force transmission path from the motor 11 to the respective moving parts will be described below.

The driving force output from the motor 11 is transmitted to the plate cylinders 1 via the blanket cylinders 2. The driving force thus received by the plate cylinders 1 is transmitted to the respective ink rollers of the ink-feeding units 5 and the roller-oscillating units via different routes. The sheet-feeding unit and the sheet-discharging unit each receive the driving force of the motor 11 via the impression cylinder 3. Specifically, the driving force transmitted to the impression cylinder 3 is transmitted to both the blanket cylinders 2, and simultaneously to the sheet-feeding cylinder 6 of the sheet-feeding unit and the sheet-discharging sprockets 8 of the sheet-discharging unit for synchronous operation. Accordingly, all of these parts are actuated in synchronization with each other during the printing operation.

The printing press as mentioned above is a digital printing press that is capable of continuously printing on sheets of several lots without the necessity to replace the printing plates. That is, the printing press is designed to automatically form images on the printing plates mounted on the plate cylinders 1 by the image forming units 4. For the automatic image-forming operation, the plate cylinders 1 must be rotated. Specifically, the plate cylinders 1 with a plurality of segments must be rotated at high speed.

However, the rotation of the plate cylinders 1 by the motor 11 causes the simultaneous rotations of not only the blanket cylinders 2 and the impression cylinder 3, but also the ink rollers, the sheet-feeding cylinder 6 and the sheet-discharging sprockets 8, as well as causing the simultaneous reciprocal movements of the oscillating rollers. The sheet-feeding unit, the sheet-discharging unit, the ink-feeding units 5 and the roller-oscillating units do not directly contribute to the image-forming operation. Therefore, the simultaneous actuation of these units may cause not only an excessive load to the motor 11, but also a longer period of time for forming the images due to the lower speed operation of the plate cylinders 1. In addition, the printing press greatly vibrates during the image forming operation.

To address the above problems, the present applicant filed a patent application (Japanese Patent Application No. Hei 11-204793 and U.S. Pat. No. 6,302,018), in which the arrangement enabling shutting-off of the driving-force transmission from the motor 11 to the sheet-feeding unit and the other units during the image-forming operation by the image-forming devices was proposed.

Specifically, clutches are respectively disposed in the respective driving-force transmission paths from the motor 11 to the sheet-feeding unit, the sheet-discharging unit, the ink-feeding units 5 and the roller-oscillating units. More specifically, a total of six clutches are respectively disposed between the impression cylinder 3 and the sheet-feeding cylinder 6, between the impression cylinder 3 and the adjacent one of the sheet-discharging sprockets 8, between the plate cylinder 1 and a corresponding set of the ink rollers on each side, and between the plate cylinder 1 and the roller-oscillating units on each side, so that the driving-force transmission to the sheet-feeding units and the other units can entirely be shut off during the image forming operation. The shutting-off of the driving-force transmission to the units or parts irrespective to the image-forming operation achieves reduction of the load applied to the motor 11, higher speed operation of the plate cylinders 1, and hence shortening of the time period for the image-forming operation.

However, the above arrangement with the clutches disposed in each transmission path necessitates a large number of clutches, and hence may result in increased manufacturing cost of the printing press.

It is an object of the present invention to provide a low-cost digital printing press that is capable of shortening a time period for the image forming by reducing the load applied to the motor during the image forming operation.

SUMMARY OF THE INVENTION

According to one aspect of the present invention, there is provided a digital printing press with an image forming device fixedly mounted thereto for forming images on printing plates. The digital printing press includes a printing unit that in turn includes a plate cylinder having the printing plates mounted thereon for printing on sheets, a sheet-feeding unit for feeding sheets to the printing unit, a sheet-discharging unit for discharging sheets printed at the printing unit from the printing unit, an ink-feeding unit that includes a plurality of ink rollers that are rotated to respectively feed inks onto the printing plates mounted on the plate cylinder with some of the ink rollers being oscillating rollers that rotate as moving in the direction parallel to the axis of the plate cylinder, and a roller-oscillating unit for driving the oscillating rollers. The printing unit, the sheet-feeding unit, the sheet-discharging unit, the ink-feeding unit and the roller-oscillating unit are adapted to receive the driving force from a common motor. The image-forming device is adapted to form images on the printing plates as the plate cylinder rotates upon receiving the driving force from the common motor. The transmission of the driving force to at least two of the sheet-feeding unit, the sheet-discharging unit, the ink-feeding unit and the roller-oscillating unit is shut off by means of a single clutch during the image-forming operation.

With this digital printing press, it is possible to shorten the time required for forming images on the printing plates, and reduce the number of clutches as compared with a conventional arrangement that several clutches are disposed corresponding to each of the units.

According to another aspect of the present invention, there is provided a digital printing press with an image forming device fixedly mounted thereto for forming images on printing plates. The digital printing press includes a printing unit that in turn includes a plate cylinder having the printing plates mounted thereon for printing on sheets, a sheet-feeding unit for feeding sheets to the printing unit, a sheet-discharging unit for discharging sheets printed at the printing unit from the printing unit, an ink-feeding unit that includes a plurality of ink rollers that are rotated to respectively feed inks onto the printing plates mounted on the plate cylinder with some of the ink rollers being oscillating rollers that rotate as moving in the direction parallel to the axis of the plate cylinder, and a roller-oscillating unit for driving the oscillating rollers. The printing unit, the sheet-feeding unit, the sheet-discharging unit, the ink-feeding unit and the roller-oscillating unit are adapted to receive the driving force from a common motor. The image-forming device is adapted to form images on the printing plates as the plate cylinder rotates upon receiving the driving force from the common motor. The transmission of the driving force to all of the sheet-feeding unit, the sheet-discharging unit, the ink-feeding unit and the roller-oscillating unit is shut off by a clutching means during the image-forming operation. The transmission of the driving force to at least two units selected from the sheet-feeding unit, the sheet-discharging unit, the ink-feeding unit and the roller-oscillating unit is shut off by means of a single clutch.

Likewise, the digital printing press of this arrangement produce the same effects as described above.

DETAILED DESCRIPTION OF THE PREFERRED EMBODIMENT

Figure 3:
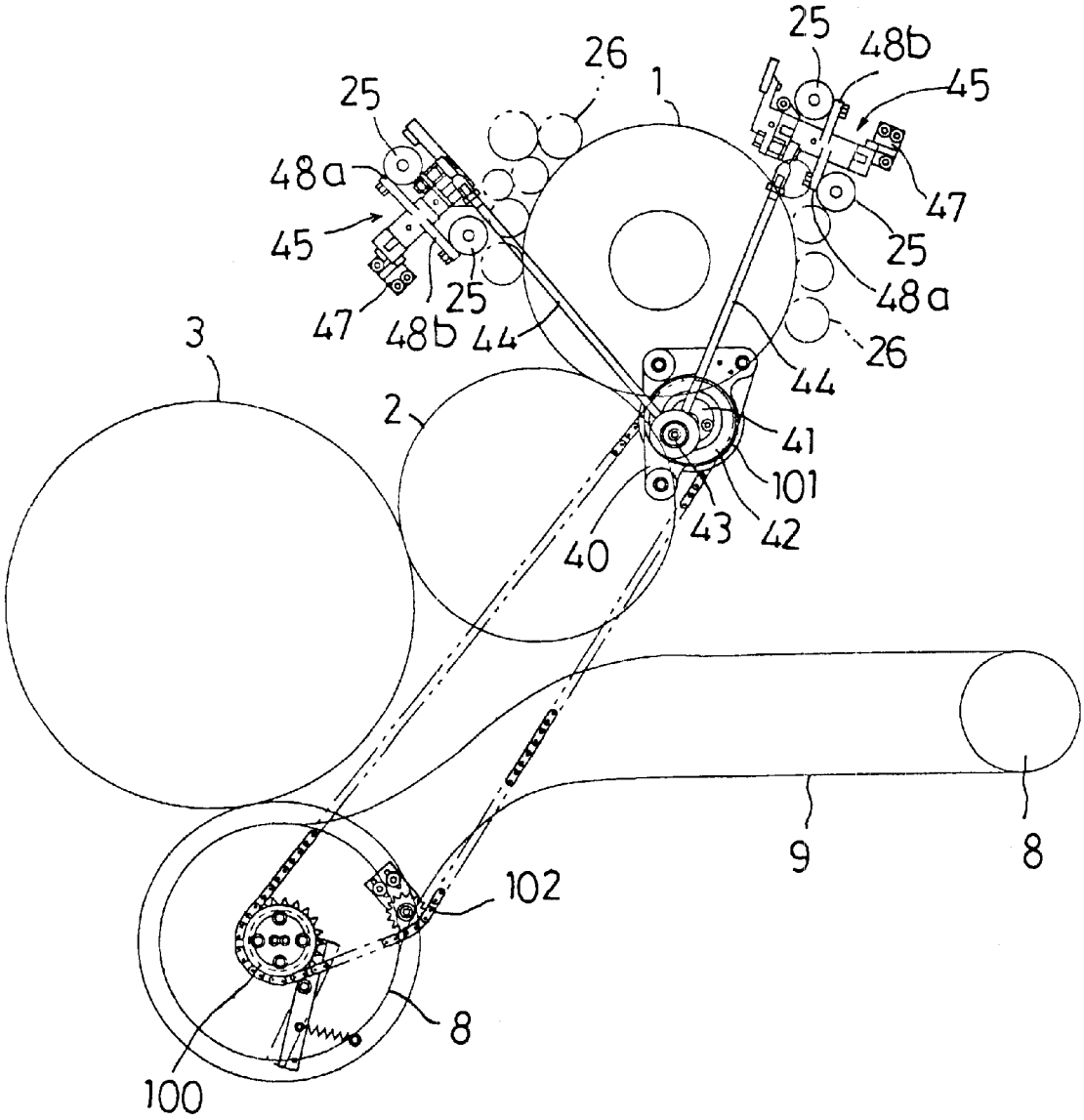
FIG. 3 is a side view schematically illustrating an essential part of the printing press.
Figure 4:
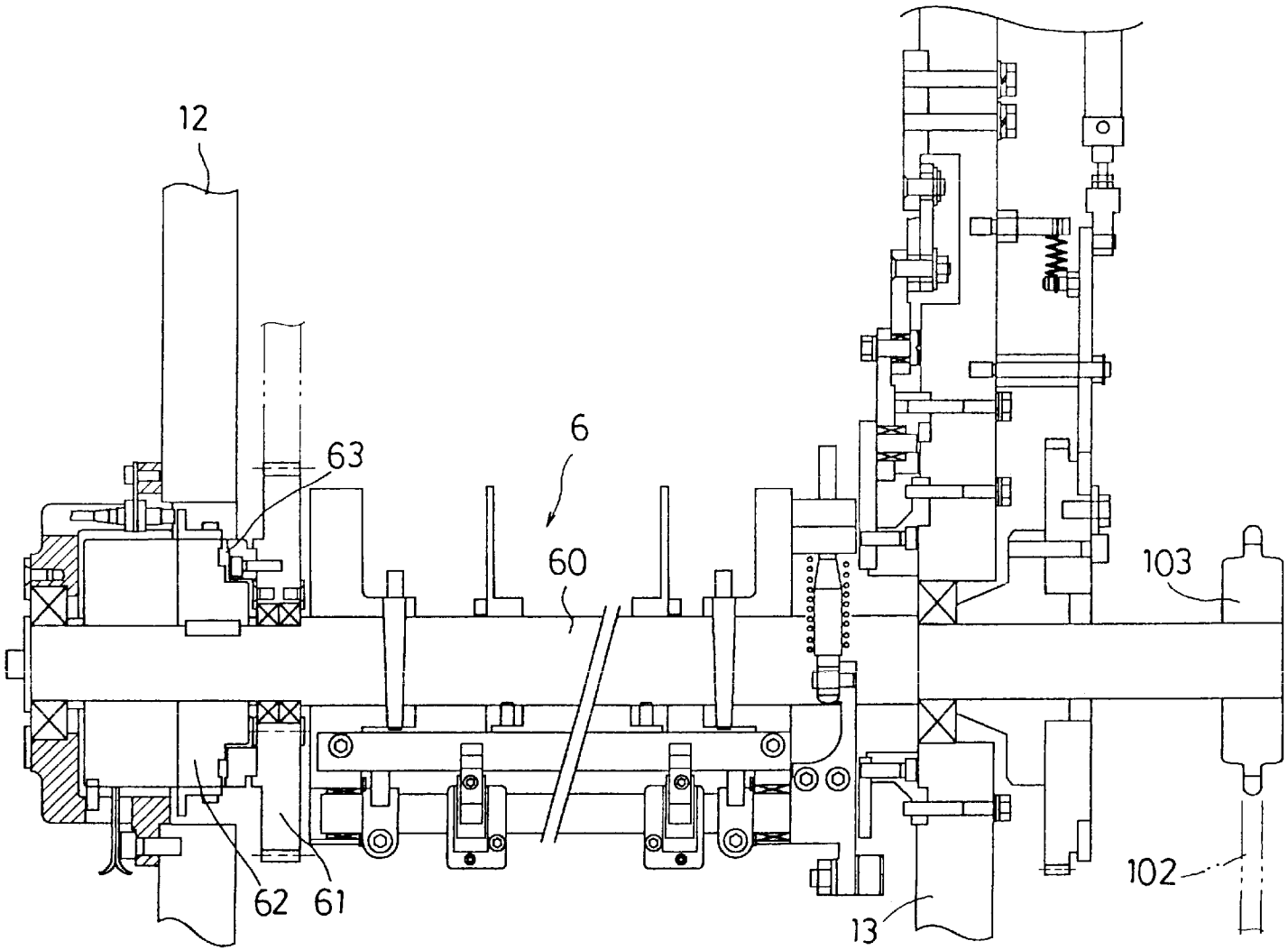
FIG. 4 is a cross section schematically illustrating an essential part of the printing press near the sheet-feeding cylinder of the printing press.
Figure 5:
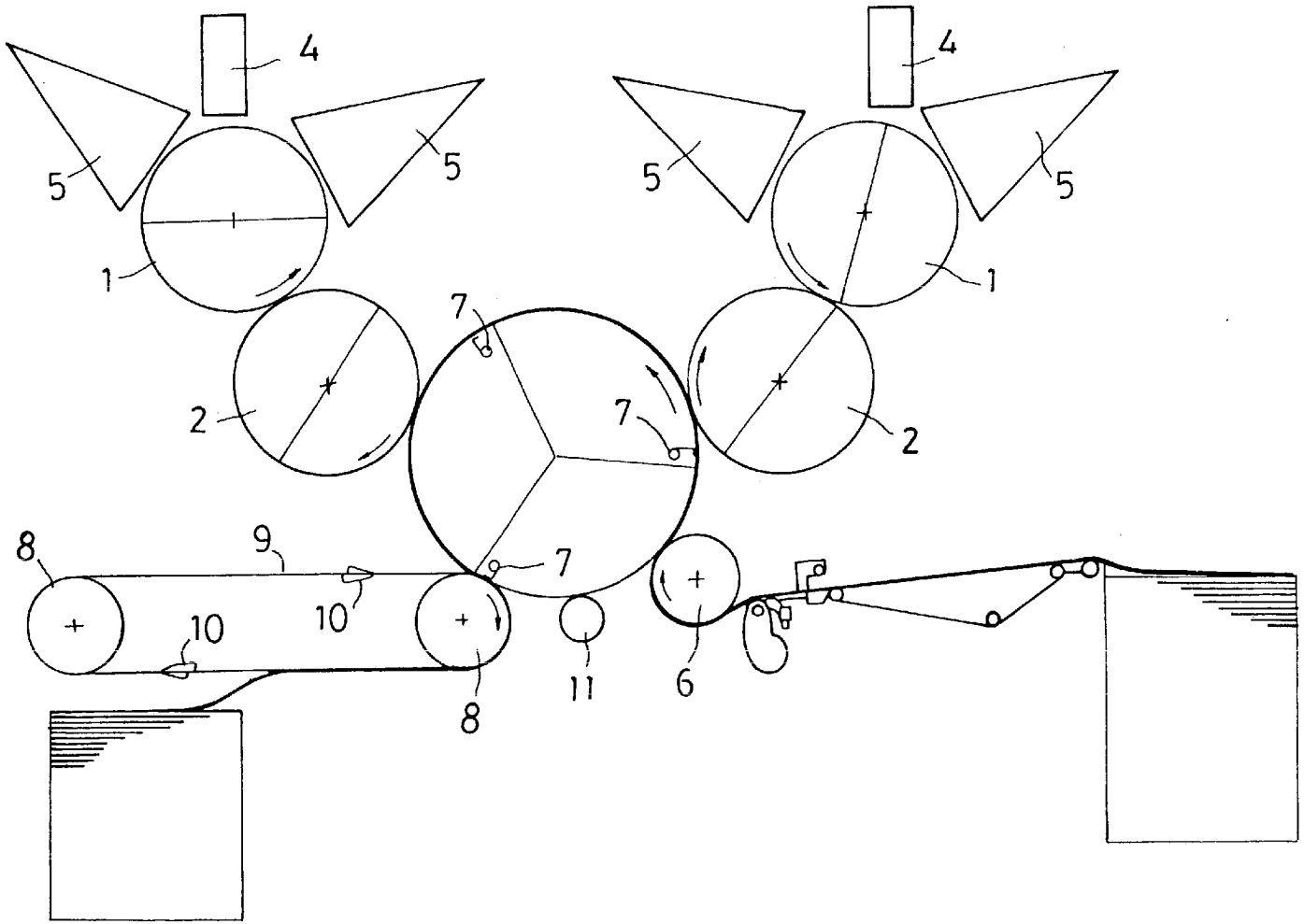
FIG. 5 is a schematic structural view of the printing press.

An embodiment of the digital offset printing press according to the present invention will be hereinafter described with reference to FIGS. 1–4, in which corresponding or identical parts to those of the printing press of FIG. 5 have been given the same reference characters to omit a detailed description thereof. In this regard, substantially the same cylinder arrangement is employed in those of FIGS. 1–4 and FIG. 5.

Figure 1:
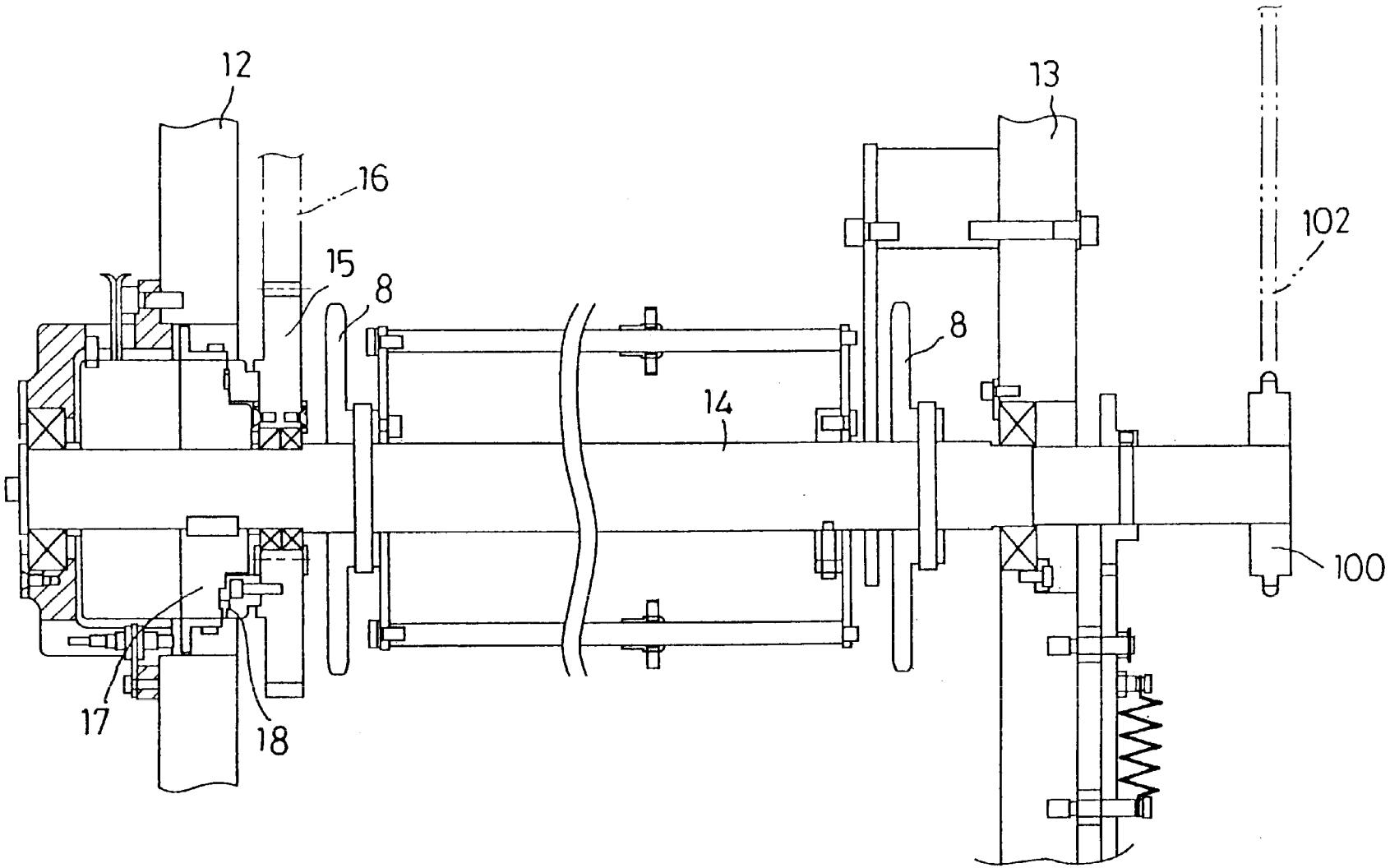
FIG. 1 is a cross section schematically illustrating an essential part of the digital printing press near the sheet-discharging unit according to one embodiment of the present invention.

FIG. 1 is a schematic view illustrating one of the sheet-discharging sprockets 8 closer to the impression cylinder 3. This sheet-discharging sprocket 8 is fixed on sprocket shaft 14 that is in turn rotatably supported via bearings by first-side frame 12 and second-side frame 13 disposed opposite to each other. With this arrangement, the sprocket 8 is rotated together with the sprocket shaft 14. Gear 15 for driving the sheet-discharging unit (hereinafter referred to as a sheet-discharging-unit-driving gear) is rotatably and coaxially mounted on the sprocket shaft 14 via a bearing in meshing engagement with gear 16 for driving the impression cylinder 3 (hereinafter referred to as an impression-cylinder-driving gear). The impression-cylinder-driving gear 16 is in turn coaxially and integrally mounted on the impression cylinder 3 in meshing engagement with an output gear of the motor 11 of the printing press (not shown).

On the axially outside of the sheet-discharging-unit-driving gear 15 is provided rotational-force-transmission member 17 that has a substantially cylindrical shape and is coaxially and integrally mounted on the sprocket shaft 14. Electromagnetic clutch 18 is disposed between the rotational-force transmission member 17 and the sheet-discharging-unit-driving gear 15 along the axial direction of the sprocket shaft 14. When the electromagnetic clutch 18 is brought into "on" state, the rotational-force-transmission member 17 is brought into integral engagement with the sheet-discharging-unit-driving gear 15. This enables the sheet-discharging-unit-driving gear 15 to receive the driving force via the rotational-force transmission member 17 and the sprocket shaft 14, and hence to be rotated together with the sheet-discharging sprocket 8. Specifically, the driving force of the motor 11 is transmitted to the sheet-discharging sprocket 8 via the output gear, the impression-cylinder-driving gear 16 and the sheet-discharging-unit-driving gear 15.

On the contrary, when the electromagnetic clutch 18 is brought into "off" state, the rotational-force-transmission member 17 is released from the integral engagement with the sheet-discharging-unit-driving gear 15, enabling the rotational-force-transmission member 17 and the sheet-discharging-unit-driving gear 15 to be rotatable with respect to each other. Specifically, by shutting off the transmission of the driving force of the motor 11 by the electromagnetic clutch 18, the sheet-discharging-unit-driving gear 15 can run idle with respect to the sprocket shaft 14.

The sprocket shaft 14 has a first end, on which the rotational-force-transmission member 17 is mounted, and a second end projecting outwardly away from the second-side frame 13 to have an outward extension on which later-described sprocket 100 for transmitting the driving force is integrally and fixedly mounted.

Now, the description will be made for the associated mechanism or parts surrounding the plate cylinders 1. The printing press has the two plate cylinders 1 on the upstream and downstream sides of the impression cylinder 3. The structures of them are similar to each other, so that the associated mechanism or parts surrounding the plate cylinder 1 on the downstream side will be taken as a representative example for the description.

Figure 2:
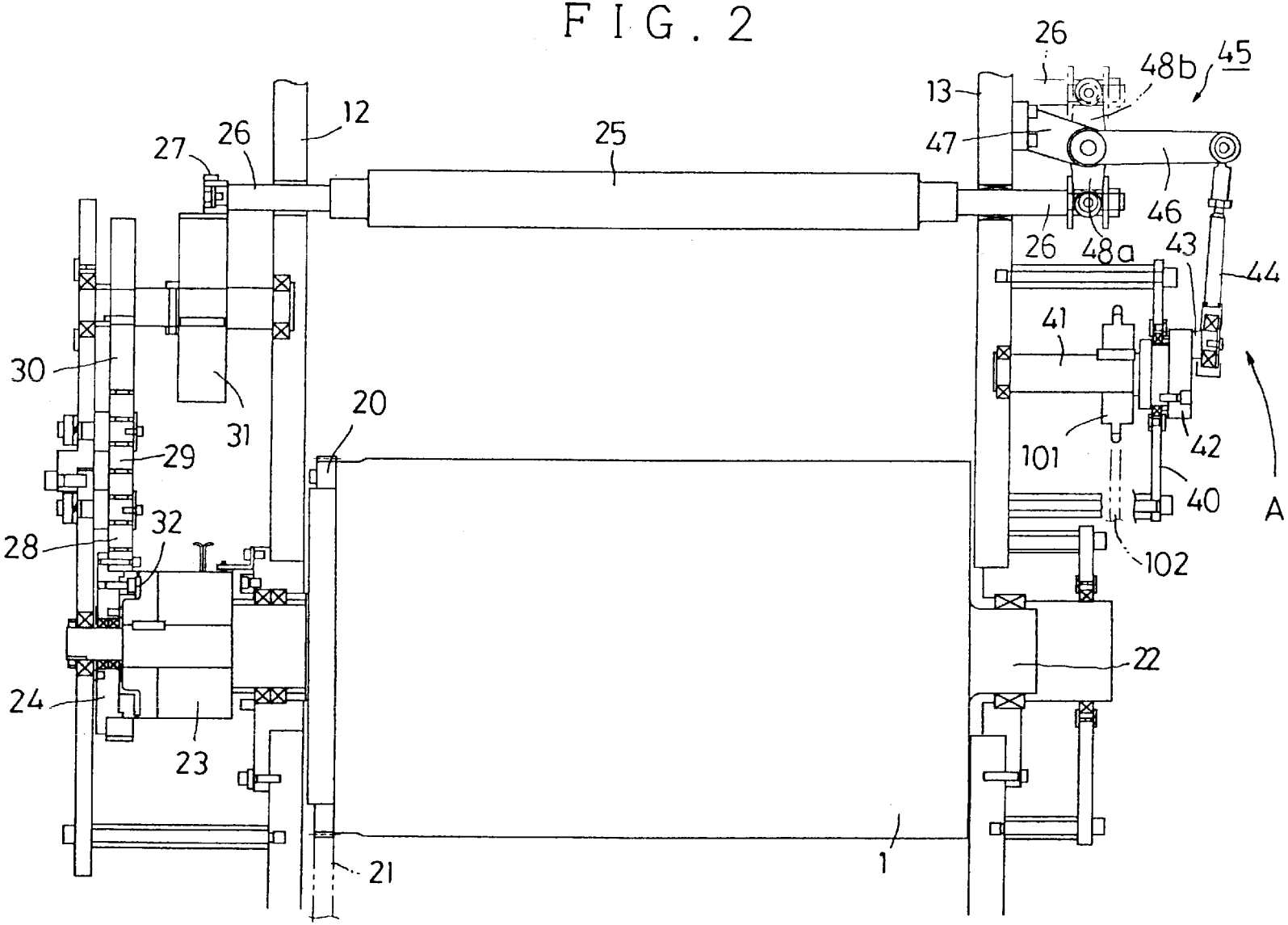
FIG. 2 is a cross section schematically illustrating an essential part of the printing press near one of the plate cylinders.

As illustrated in FIG. 2, the plate cylinder 1 has a first end to which gear 20 for driving the plate cylinder 1 (hereinafter referred to as a plate-cylinder-driving gear) is coaxially fixed. The plate-cylinder-driving gear 20 is meshed with gear 21 for driving the blanket cylinder 2 (hereinafter referred to as a blanket-cylinder-driving gear), which is in turn meshed with the impression-cylinder-driving gear 16. Thus, the transmission of the driving force of the motor 11 to the plate cylinder 1 is carried out on the inner side of the first-side frame 12.

The plate cylinder 1 is integrally formed with plate-cylinder shaft 22, which is in turn rotatably supported by the first-side frame 12 via a bearing. The plate-cylinder shaft 22 has a first end projecting outwardly from the first-side frame 12, to which a rotational-force-transmission member 23 having a substantially cylindrical shape is coaxially fixed. The rotational-force-transmission member 23 thus fixed is rotatable together with the plate-cylinder shaft 22. On the axially outer side of the plate-cylinder shaft 22 than the rotational-force-transmission member 23 is provided first gear 24 that is rotatably mounted thereon via a bearing.

The ink-feeding units 5 each include a number of ink rollers, some of which are designed as the oscillating rollers. FIG. 2 illustrates as a representative example for the description one of the oscillating rollers, which is denoted by a reference numeral 25. This oscillating roller 25 is formed integral with roller shaft 26, which is in turn rotatably supported by the first- and second-side frames 12, 13 via bearings. The roller shaft 26 has a first end projecting outwardly through the first-side frame 12 to have an extension, on which gear 27 for rotationally driving the oscillating roller 25 (hereinafter referred to as a roller-driving gear) is coaxially and integrally mounted. The roller-driving gear 27 and the first gear 24 are operatively connected to each other via a gear train comprised of four gears 28, 29, 30 and 31.

Electromagnetic clutch 32 is disposed between the first gear 24 and the rotational-force-transmission member 23 along the axial direction of the plate-cylinder shaft 22. When the electromagnetic clutch 32 is brought into the "on" state, the rotational-force-transmission member 23 is brought into integral engagement with the first gear 24, enabling the first gear 24 to be synchronously rotated with the plate cylinder 1. This rotational force is transmitted to the roller-driving gear 27 via the gear train, thereby enabling the oscillating roller 25 to be synchronously rotated with the plate cylinder 1. On the other hand, when the electromagnetic clutch 32 is brought into the "off" state, the first gear 24 is released from the integral engagement with the rotational-force-transmission member 23, enabling the plate-cylinder shaft 22 to run idle with respect to the first gear 24. That is, the printing unit is brought into a state where the transmission of the driving force from the plate cylinder 1 to the oscillating roller 25 has been shut-off by means of the electromagnetic clutch 32.

Thus, the transmission of the driving force or rotational force from the plate cylinder 1 to the ink rollers and the oscillating rollers is carried out on the outer side of the first-side frame 12.

On the outer side of the second-side frame 13 is provided roller-oscillating unit X that is designed to reciprocate the oscillating roller 25 in the lateral direction or the direction parallel to the axis of the plate cylinder 1. The roller-oscillating unit X which is also called as a rolling mechanism enables the oscillating roller 25 to be reciprocated with the driving force outputted from the motor 11 via a link mechanism as a motion converting means for converting rotary motion into linear motion.

Now, the detailed description will be made for the roller-oscillating unit X. Rotational shaft 41 is rotatably supported by the second-side frame 13 and sub-frame 40 extending parallel with the second-side frame 13. Driving-force-transmission sprocket 101 is integrally mounted on the rotational shaft 41 for the transmission of the driving force. Circular plate 42 is coaxially and integrally mounted on the outer end of the rotational shaft 41. Rod-supporting member 43 projects axially outwardly from the circular plate 42 with its axis eccentric to the axis of the rotational shaft 41 and is designed to rotatably receive a first end of rod 44 via a bearing. A second end of the rod 44 is rotatably coupled to an axially outer end of lever body 46 of swing lever 45 via a bearing. The lever body 46 has an axially inner end rotatably supported by bracket 47 attached on the outer surface of the second-side frame 13, so that the lever body 46 can be pivoted about the bracket 47. The lever body 46 is set in such a position to have a longitudinal axis being substantially orthogonal to the second-side frame 13, when the swing lever 45 lies along the center of its pivoting range. A pair of arms 48*a*, 48*b* are integrally formed on the inner end of the lever body 46 with their axes extending in the opposite directions, that is, the direction substantially orthogonal to the lever body 46, and substantially parallel to the frame 13 when the swing lever 45 lies along the center of its pivoting range.

A second end of the roller shaft 26 projects outwardly through the second-side frame 13 and is rotatably connected to the arm 48*a*. Likewise, a second end of the roller shaft 26 of another oscillating roller is connected to the arm 48*b*.

The components of the roller-oscillating unit X are moved in the following manner.

The driving-force-transmission sprocket 101, which received the driving-force of the motor 11, transmits the driving force to the circular plate 42. The circular plate 42 then rotates with the transmitted driving force and causes the eccentric rotation of the rod-supporting member 43. This eccentric rotation in turn causes the swing lever 45 to swing via the rod 44. Specifically, the arms 48*a*, 48*b* swing within a predetermined angular range, simulating the motion of a oscillating pendulum, so that the one oscillating roller 25 connected to the arm 48*a* and the other oscillating roller 25 connected to the arm 48*b* are reciprocally moved towards the opposite directions.

In this embodiment, two ink-feeding units 5 are provided for each plate cylinder 1. Accordingly, two rods 44 are respectively rotatably connected to the single rod-supporting member 43, as illustrated in FIG. 3, so that the oscillating rollers 25 of the ink-feeding units 5 are independently oscillated upon receiving the driving force via the rods 44.

The driving force to the roller-oscillating unit X is transmitted not through the plate cylinder 1, but the sprocket shaft 14 in the sheet-discharging unit. Specifically, as illustrated in FIGS. 1–3, on the outside of the frame 13 is provided endlessly-formed connecting chain 102 that is wound between the driving-force-transmitting sprocket 100 mounted on the sprocket shaft 14 and the driving-force-transmitting sprocket 101 mounted on the rotational shaft 41. Whereby, the sheet-discharging unit and the roller-oscillating unit X are actuated in synchronization with each other. The transmission of the driving force to the roller-oscillating unit X is thus achieved via the sheet-discharging unit.

According to the above arrangement, when the electromagnetic clutch 18 in the sheet-discharging unit as illustrated in FIG. 1, that is, as disposed between the impression cylinder 3 and the sheet-discharging sprocket 8 is "on", the driving force is transmitted also to the roller-oscillating unit X via the connecting chain 102. On the contrary, when the electromagnetic clutch 18 is brought into the "off" state, the driving force to the roller-oscillating unit X is shut off. Thus, the electromagnetic clutch 18 solely interposed between the impression cylinder 3 and the sheet-discharging unit shuts off the transmission of the driving force to the roller-oscillating unit X for the oscillating rollers 25 of the plate cylinder 1 on the downstream side and to the sheet-discharging unit.

The transmission of the driving force to the roller-oscillating unit X of the plate cylinder 1 on the upstream side is made substantially in the same manner as that on the downstream side. As illustrated in FIG. 4, the sheet-feeding cylinder 6 is integrally mounted on sheet-feeding-cylinder shaft 60 that is rotatably supported by the first-side and second-side frames 12, 13 via bearings. On the inner side of the first-side frame 12 is provided sheet-feeding-cylinder-driving gear 61 for driving the sheet-feeding cylinder 6, which is rotatably mounted on the sheet-feeding-cylinder shaft 60 via a bearing in meshing engagement with the impression-cylinder-driving gear 16. On the outer side of the sheet-feeding-cylinder-driving gear 61 is provided rotational-force-transmitting member 62 that has a substantially cylindrical shape and is integrally mounted on the sheet-feeding-cylinder shaft 60. Electromagnetic clutch 63 is interposed between the rotational-force-transmitting member 62 and the sheet-feeding-cylinder-driving gear 61. According to this arrangement, when the electromagnetic clutch 63 is "on", the rotational-force-transmitting member 62 and the sheet-feeding-cylinder-driving gear 61 are rotated integrally with each other, so that the driving force is transmitted to the sheet-feeding cylinder 6 via the impression cylinder 3, the sheet-feeding-cylinder-driving gear 61, the rotational-force-transmitting member 62 and the sheet-feeding-cylinder shaft 60. On the contrary, when the electromagnetic clutch 63 is brought into the "off" state, the electromagnetic clutch 63 shuts off the transmission of the driving force to the sheet-feeding cylinder 6.

The sheet-feeding-cylinder shaft 60 extends outwardly through the second-side frame 13 to have an extension on which sprocket 103 for transmitting the driving force (hereinafter referred to as a driving-force-transmitting sprocket) is integrally mounted. On the outer side of the first-side frame 13 is provided endlessly-formed connecting chain 102 that is wound between the driving-force-transmitting sprocket 103 mounted on the sheet-feeding-cylinder shaft 60 and the driving-force-transmitting sprocket 101 for the driving-force transmission of the roller-oscillating unit X for the plate cylinder 1 on the upstream side, in the same manner as the downstream side. This connecting chain 102 transmits via the sheet-feeding cylinder 6 the driving force of the motor 11 to the roller-oscillating unit X for the plate cylinder 1 on the upstream side. As described above, the plate cylinder 1 and its peripheral parts or elements on the upstream side have the same constructions as those of the downstream side as illustrated in FIG. 2, so that the description for them will be omitted.

The transmission of the driving force to the roller-oscillating unit X on the upstream side is also shut off by bringing the electromagnetic clutch 63 interposed between the impression cylinder 3 and the sheet-feeding cylinder 6 into the "off" state.

Thus, the single electromagnetic clutch 63 interposed between the impression cylinder 3 and the sheet-feeding unit shuts off the transmission of the driving force to the roller-oscillating unit X for the oscillating rollers 25 of the plate cylinder 1 on the upstream side and to the sheet-feeding unit.

According to the thus arranged printing press, all the electromagnetic clutches are held in the "on" state during the printing operation, so that the sheet-feeding unit, the sheet-discharging unit, the ink-feeding units 5 and the roller-oscillating units X are actuated in synchronization with the printing unit. On the other hand, during the image-forming units 4 form images on the printing plates, all the electromagnetic clutches are held in the "off" state. That is, all the clutches respectively interposed between the plate cylinder 1 and a set of the ink-feeding units 5 on the upstream side, between the plate cylinder 1 and a set of the ink-feeding units 5 on the downstream side, between the impression cylinder 3 and the sheet-feeding unit, and between the impression cylinder 3 and the sheet-discharging unit are simultaneously brought into the "off" state to shut off the transmission of the driving force to the ink-feeding units 5, the sheet-feeding unit, the sheet-discharging unit and the respective roller-oscillating units X. This shutting-off of the transmission of the driving force to these units achieves the reduction of the load applied to the motor 11, and hence the high-speed rotation of the plate cylinders 1. As a result, the time required for image-forming operation may be shortened.

The printing press of this embodiment is designed so that the electromagnetic clutch 63 between the impression cylinder 3 and the sheet-feeding cylinder 6 additionally shuts off the transmission of the driving force to the roller-oscillating unit X on the upstream side, while the electromagnetic clutch 18 between the impression cylinder 3 and the sheet-discharging sprocket 8 additionally shuts off the transmission of the driving force to the roller-oscillating unit X on the downstream side. Accordingly, the additional two electromagnetic clutches as needed in the conventional printing press can be omitted, and therefore the printing press can be manufactured at a reduced cost.

Subsequent to the image-forming operation, both the electromagnetic clutches 32 on the upstream and downstream sides, each disposed between the corresponding plate cylinder 1 and the corresponding set of the ink-feeding units 5 are brought into the "on" state, and both the electromagnetic clutches 63, 18 interposed on the both sides of the impression cylinder 3 with respect to the sheet-feeding unit and the sheet-discharging unit are also brought into the "on" state at a slightly different timing. This operational mode enables the oscillating rollers 25 to start their reciprocal motions after the start of their rotational motions. As a result, damages to the oscillating rollers 25 may be limited.

In this embodiment, the roller-oscillating unit X on the upstream side and the sheet-feeding unit, and the roller-oscillating unit X on the downstream side and the sheet-discharging unit respectively constitute operational units, so that the electromagnetic clutches 63, 18 shut off the transmission of the driving force to these operational units. It is a matter of course that any combinations of those units may be employed. For example, it is possible to employ the arrangement that a single electromagnetic clutch selectively enables and disables the driving-force transmission to an operational unit comprised of a set of ink-feeding units 5, the sheet-feeding unit, the sheet-discharging unit and the like, and another single electromagnetic clutch selectively enables and disables the driving-force transmission to another operational unit comprised of a set of ink-feeding units 5 and the roller-oscillating units X.

It is possible to arbitrarily combine two units selected from the sheet-feeding unit, sheet-discharging unit, ink-feeding units 5 and roller-oscillating units X, and shut off the transmission of the driving-force to these two units by means of a single electromagnetic clutch.

It is a matter of course that a single electromagnetic clutch shuts off the transmission of the driving force to more than two units selected from the sheet-feeding unit, sheet-discharging unit, ink-feeding units 5 and roller-oscillating units X.

The endlessly-formed connecting chain 102 employed in this embodiment may be replaced by a belt, a gear train or the like.

It is also possible to employ any types of clutches other than the electromagnetic clutch, such as a mechanical clutch using an air cylinder.

It is not necessary to limit the cylinder arrangement of the printing press to this embodiment. For example, the present invention can be adapted to a multi-color printing press that has a plurality of impression cylinders 3 aligned in series via transfer drums. Particularly, the present invention is greatly advantageous when applied to the printing press that has the plate cylinder 1 with a plurality of segments.

In this embodiment, the driving-force transmissions to the sheet-feeding unit, the sheet-discharging unit, the sets of the ink-feeding units 5 and the roller-oscillating units X are shut off during the image forming operation. However, the shutting-off of the driving-force transmission to all the units is not essential to the present invention. The units for which the driving-force transmission is shut off may be varied in number as long as the drive-force transmission to two or more units is shut off.

This specification is by no means intended to restrict the present invention to the preferred embodiments set forth therein. Various modifications to the digital printing press, as described herein, may be made by those skilled in the art without departing from the spirit and scope of the present invention as defined in the appended claims.

What is claimed is:

1. A digital printing press with an image forming device fixedly mounted thereto for forming images on printing plates comprising:

a printing unit including a plate cylinder having said printing plates mounted thereon for printing on sheets;

a sheet-feeding unit for feeding sheets to said printing unit;

a sheet-discharging unit for discharging sheets printed at said printing unit from the printing unit;

an ink-feeding unit including a plurality of ink rollers that are rotated to respectively feed inks onto the printing plates mounted on the plate cylinder with some of said ink rollers being laterally-oscillating rollers that rotate as moving in the direction parallel to the axis of the plate cylinder;

a roller-oscillating unit for driving said laterally-oscillating rollers;

wherein the printing unit, the sheet-feeding unit, the sheet-discharging unit, the ink-feeding unit and the roller-oscillating unit are adapted to receive the driving force from a common motor;

wherein the image-forming device is adapted to form images on the printing plates as the plate cylinder rotates upon receiving the driving force from said common motor; and wherein the transmission of the driving force to at least two of the sheet-feeding unit, the sheet-discharging unit, the ink-feeding unit and the roller-oscillating unit is shut off by means of a single clutch during the image-forming operation.

2. A digital printing press with an image forming device fixedly mounted thereto for forming images on printing plates comprising:

a printing unit including a plate cylinder having said printing plates mounted thereon for printing on sheets;

a sheet-feeding unit for feeding sheets to said printing unit;

a sheet-discharging unit for discharging sheets printed at said printing unit from the printing unit;

an ink-feeding unit including a plurality of ink rollers that are rotated to respectively feed inks onto the printing plates mounted on the plate cylinder with some of said ink rollers being laterally-oscillating rollers that rotate as moving in the direction parallel to the axis of the plate cylinder;

a roller-oscillating unit for driving said laterally-oscillating rollers;

wherein the printing unit, the sheet-feeding unit, the sheet-discharging unit, the ink-feeding unit and the roller-oscillating unit are adapted to receive the driving force from a common motor;

wherein the image-forming device is adapted to form images on the printing plates as the plate cylinder rotates upon receiving the driving force from said common motor;

wherein the transmission of the driving force to all of the sheet-feeding unit, the sheet-discharging unit, the ink-feeding unit and the roller-oscillating unit is shut off by a clutching means during the image-forming operation; and wherein the transmission of the driving force to at least two units selected from the sheet-feeding unit, the sheet-discharging unit, the ink-feeding unit and the roller-oscillating unit is shut off by means of a single clutch.

* * * * *